United States Patent [19]

Anzai

[11] Patent Number: 4,783,679

[45] Date of Patent: Nov. 8, 1988

[54] COPYING MACHINE FOR COPYING A PLURALITY OF SMALL ORIGINALS IN A SINGLE OPERATION

[75] Inventor: Shunju Anzai, Nara, Japan

[73] Assignee: Sharp Kabushiki Kaisha, Osaka, Japan

[21] Appl. No.: 835,633

[22] Filed: Mar. 3, 1986

[30] Foreign Application Priority Data

Mar. 7, 1985 [JP] Japan ..... 60-47081

[51] Int. Cl.[4] ..... G03G 15/00

[52] U.S. Cl. ..... 355/7; 355/14 SH; 355/75

[58] Field of Search ..... 355/7, 8, 14 R, 14 SH, 355/14 C, 75, 133

[56] References Cited

U.S. PATENT DOCUMENTS

| | | | |
|---|---|---|---|
| 4,078,862 | 3/1978 | Kuwana | 355/40 |
| 4,142,792 | 3/1979 | Satomi et al. | 355/14 R |
| 4,217,052 | 8/1980 | Tani et al. | 355/8 |
| 4,315,687 | 2/1982 | Breuers et al. | 355/75 |

FOREIGN PATENT DOCUMENTS

| | | | |
|---|---|---|---|
| 2806397 | 8/1978 | Fed. Rep. of Germany . | |
| 53-91749 | 8/1978 | Japan | 355/14 R |
| 59-180568 | 10/1984 | Japan | 355/8 |
| 59-198075 | 11/1984 | Japan | 355/8 |
| 59-224854 | 12/1984 | Japan | 355/14 C |
| 2041889 | 9/1980 | United Kingdom | 355/14 SH |

*Primary Examiner*—Arthur T. Grimley
*Assistant Examiner*—J. Pendegrass
*Attorney, Agent, or Firm*—Birch, Stewart, Kolasch & Birch

[57] ABSTRACT

Disclosed is an electrophotographic copying machine which is provided with an original-setting table and copying-paper delivery devices featuring provision of a original-setting plate that allows a plurality of originals to be mounted on the original-setting table, circuits for generating timing signals matching the positions of a plurality of originals mounted together with the original-setting plate on the original-setting table, and a copying-paper feeding device for delivering copying papers in response to the timing signals thus generated.

3 Claims, 3 Drawing Sheets

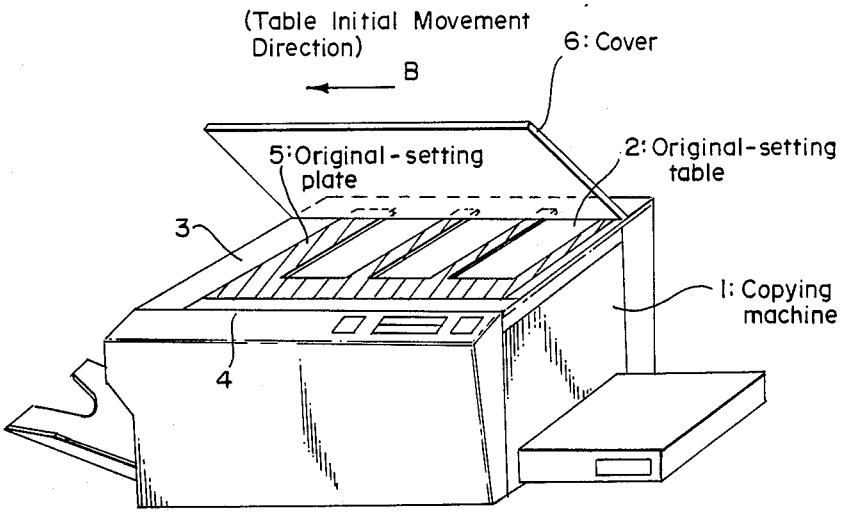
FIG. 1
FIG. 5(A)
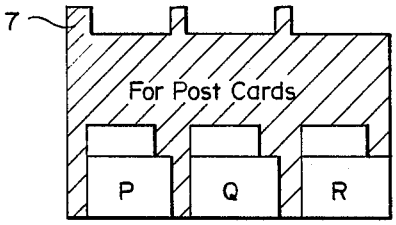
FIG. 5(B)
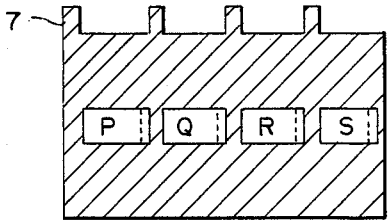

COPYING MACHINE FOR COPYING A PLURALITY OF SMALL ORIGINALS IN A SINGLE OPERATION

BACKGROUND OF THE INVENTION

The present invention relates to an electrophotographic copying machine which is provided with an original-alignment table and copy paper feeder.

When copying a particularly small original, such as a post card or name card using a conventional copying machine, copying is normally performed by aligning one edge of the original with a designated position on the original table. However, since the original table provides only one position for aligning the original, only one original can be copied at a time. Even copying machines provided with a function allowing continuous copying of a number of originals, have only one original-alignment position, thus requiring the operator to spend a great deal of time at the copying machine when copying a number of very small originals.

SUMMARY OF THE INVENTION

The present invention provides means for effectively solving the disadvantages described above by providing a copying machine which copies a plurality of very small originals such as post cards or name cards onto a corresponding plurality of copy papers in one copying operation.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from the following detailed description.

The copying machine reflecting the present invention comprises an original-alignment plate that enables placement of a plurality of originals on an original-alignment table, means for generating timed signals that correspond to the position of papers on the table and means for feeding copying papers in response to the generated timed signal.

BRIEF DESCRIPTION OF THE DRAWINGS

The present invention will be better understood from the detailed description given hereinbelow and the accompanying drawings which are given by way of illustration only, and thus are not limitative of the present invention and in which:

FIG. 1 is a perspective view of a copying machine reflecting the present invention;

FIGS. 5(A) and 5(B) show configurations of the original-setting plates reflecting further preferred embodiments of the present invention.

DETAILED DESCRIPTION OF THE PREFERRED EMBODIMENTS

Figure 2A:
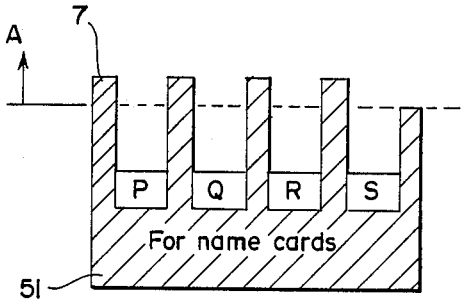
FIGS. 2(A) and 2(B) is a diagram denoting the relationship between the original-setting plate, original-setting table, and the copying machine, viewed from above.

FIG. 1 is a perspective view of a copying machine reflecting a preferred embodiment of the present invention. Reference numeral 1 indicates the copying machine. Reference numeral 2 indicates a reciprocating original-setting table (hereinafter called the original-table), part of which is provided with a basic original-setting position and designation boards 3 and 4. Normally, an original is set in position with reference to the designation boards 3 and 4 and is held with a closing cover 6, before a operation copying is performed. Reference numeral 5 indicates an original-setting plate which is placed on the original table 2, the original-setting plate being provided with a plurality of positions for setting a corresponding plurality of very small originals, such as post cards and name cards.

FIG. 2 shows the relationship between the original-setting plate and the copying machine upon which it is mounted. Reference numeral 51 indicates an original-setting plate designed for placing four name cards set to four positions P, Q, R and S. Reference numeral 7 indicates a timing-detect mark indicated by arrow A. When the copying table shifts position, a sensor 8 detects this mark to allow the copying machine to deliver copy papers.

Figure 2B:
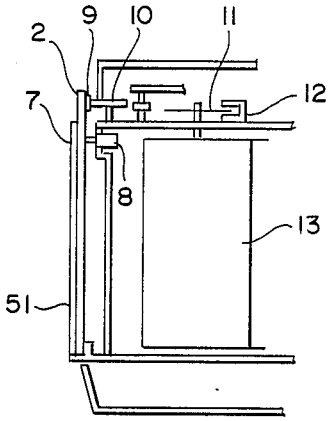

FIG. 2(B) is a sectional view from above of the copying machine designating the positional relationship between the original-setting plate 51 and the copying machine 1. The sensor 8 for detecting the timing-detect mark 7 is installed under the original table 2. The reference numerals 9 and 10 are gears used for reciprocating the original table 2. Reference numeral 13 indicates a photoreceptive drum, and represents 11, a timing disk set to to the shaft of the photoreceptive drum 13, and a sensor 12 detects the timing of this timing disk 11. The timing-detect mark 7 is set outside the original placing area of the original table 2. The surface of the original table 2 is black and does not reflect light. In other words, sensor 8 detects the position of the original in response to the presence and absence of light reflection. Sensor 12 detects the timing of the feeding paper after the formation of a latent image on the photoreceptive drum 13 and, by counting the detected pulses, the system allows both the latent image on the drum 13 and the leading edge of the copying paper to be correctly aligned.

Figure 3:
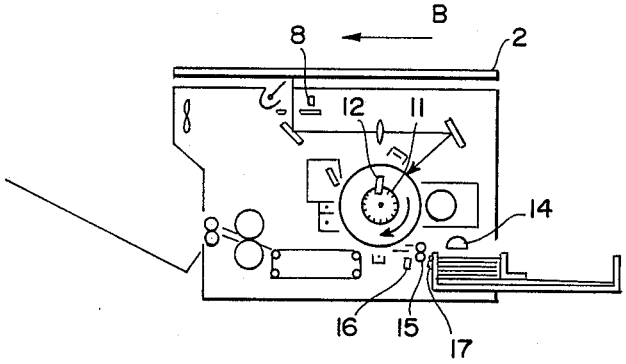
FIG. 3 is a simplified side view denoting the internal configuration of a copying machine according to the present invention.

FIG. 3 shows the internal configuration of the copying machine. Provided within the copying machine is a paper-feeding roller 14, a paper-stop roller 15 an incoming-paper detect switch 16, the delivered-paper detect switch 17. The paper-feeding roller 14 delivers copy paper to the paper stop roller 15, which then starts to rotate at a specific timing for conveying the copy paper to the photoreceptive drum 13. The delivered-paper detect switch 17 detects whether copying paper has been fed or not, whereas the incoming-paper detect switch 16 detects whether copying paper has been delivered to the photoreceptive drum 13 from the paper-stop roller 15. Timing of the paper-feeding roller 14 and the paper-stop roller 15 is controlled by signals from the timing sensors 8 and 12.

Figure 4:
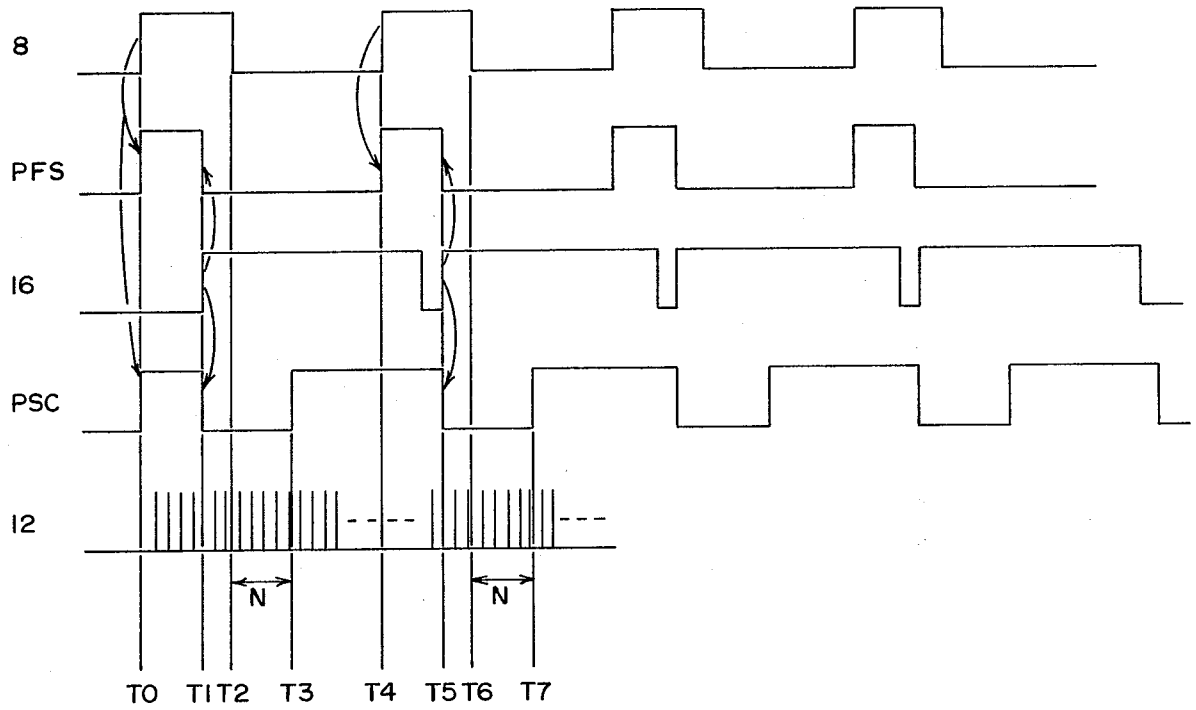
FIG. 4 is a timing chart denoting the timing of the sensors and driving unit during a copying operation.

FIG. 4 is a timing chart denoting the operation timing of both rolls. The reference numeral 8' indicates the signal output from the sensor 8 for detecting the timing-detect mark set to part of the original-setting plate. The reference numeral 16' indicates the output from the incoming paper detect switch 16. The reference numeral 12' indicates the output signals from the sensor 12 of the timing disk detecting the distance (angle) of the rotation of the photoreceptive drum 13. PFS denotes the paper-feeding solenoid signal used for controlling the operation of paper-feeding roller 14. PSC denotes signal of the clutch controlling the operation of the paper-stop roller 15. In FIG. 4, when the sensor 8 is activated by timing T0 due to absence of light reflection, PFS is also activated so that the paper-feeding operation can be executed. Simultaneously, PSC is also activated to rotate the paper-stop roller 15. Conversely, when the incoming paper detect switch 16 is activated at timing T1, the PFS and PSC signal are both turned OFF, thus causing the paper-stop roller 15 to stop the movement of the copying paper. Then, as soon as the sensor 8 detects light reflection, that is, the original table 2 proceeds to the leading edge of the first original, the controller starts to count the number of output signals from the sensor 12. When the counted number reaches N, timing T3, the paper-delivery timing at which the latent image on the photoreceptive drum 13 exactly matches the edge of the copying paper, the PSC signal is again activated so hat the paper-stop roller 15 can convey the copying paper. As soon as to sensor 8 detects the second mark as the original table 2 proceeds further, the PFS signal is activated so that the following copying paper can also be fed. When the entry of the following copying paper is detected at timing T5 after the first copying paper has passed the incoming paper detect switch 16, PFS and PSC are both turned OFF to stop the movement of the second sheet of copying paper. As soon as the signal from the sensor 8 is turned OFF as the original table proceeds yet further, that is, when the original table 2 moves to the edge position of the second original, the number of output signals from the sensor 12 is again counted, and when the counted value reaches N, the PSC signal is activated to deliver the second copying paper to the photoreceptive drum 13. By identical operations, the third and fourth sheets of copying paper are sequentially delivered to allow the system to execute copying of 4 originals by applying the exposure only once. Clogged paper is immediately detected by signals from the delivered-paper detect switch 17 installed between the paper cassette and paper-stop roller 15 and also by a signal from the sensor 12 detecting timing pulses from the incoming paper detect switch 16 and the photoreceptive drum 13. FIGS. 5(A) and (B) are other examples of original-setting plates. Model (A) is an original-setting plate designed for copying 3 post cards by setting these to designated positions (a), (b) and (c). As is clear from FIG. 5, the originals can be set either vertically or horizontally, while either of these directions can be selected depending upon the kind of copy paper cassette. In addition, since part of each original setting area is cut out, the operator can easily set and remove each original. Model (B) is an original-setting plate specially-designed for copying 4 library cards at one time by placing 4 originals in positions (a), (b), (c) and (d). Each original can easily and correctly be placed in each original area by aligning the original edge with the left-end of the original-setting area. Note that the original-setting plate is provided with a white surface that faces the original table 2 and ensures light reflection. However, these plates may be made of transparent plates, each having a maximum thickness of 0.3 mm.

Due to the configurations of the copying machine described above, by placing a plurality of very small originals such as post cards and name cards on the original table, a plurality of copies can be made by a single copying operation. Furthermore, a plurality of very small originals can easily and precisely be set to designated positions.

While only certain embodiments of the present invention have been described, it will be apparent to those skilled in the art that various changes an modifications be made therein without departing from the spirit and scope of the present invention as claimed.

What is claimed is:

1. An electrophotographic copying machine provided with an original-setting table and copy-paper feeding means comprising:

an original-setting plate having a plurality of openings formed therein and overlaying said original setting table for allowing a plurality of originals to be mounted on said original-setting table according to said plurality of window openings;

a plurality of timing detection marks provided on said said original setting plate at predetermined positions between each said plurality of window openings for automatically defining a number of said plurality of originals to be copied;

means for generating a plurality of timing signals matching the predetermined positions of each said plurality of timing detection marks defining said plurality of originals mounted together with said original-setting plate on said original-setting table; and means for sequentially feeding a plurality of said copy papers in response to each of said plurality of timing signals, whereby each of said plurality of originals is copied onto a corresponding one of said plurality of copy papers in a single copying operation.

2. The copying machine according to claim 1, wherein said plurality of originals are very small.

3. The copying machine according to claim 1, wherein said means for generating a plurality of timing signals is a sensor positioned in a fixed location beneath said original-setting table for photoelectrically detecting each said plurality of timing detection marks, whereby said sensor detects the position of each said plurality of originals in response to the presence and absence of light reflection, and wherein one of said plurality of copy papers is delivered for each said timing signal generated.

* * * * *